US008746161B2

(12) United States Patent
Tashiro et al.

(10) Patent No.: US 8,746,161 B2
(45) **Date of Patent: *Jun. 10, 2014**

(54) SEWING MACHINE AND COMPUTER-READABLE MEDIUM STORING SEWING MACHINE CONTROL PROGRAM

(75) Inventors: Noriharu Tashiro, Nagoya (JP); Tsuneo Okuyama, Nagoya (JP); Hirotsugu Takahata, Nagoya (JP); Harumi Kato, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 916 days.

This patent is subject to a terminal disclaimer.

(21) Appl. No.: 12/900,142

(22) Filed: Oct. 7, 2010

(65) Prior Publication Data

US 2011/0083598 A1 Apr. 14, 2011

(30) Foreign Application Priority Data

Oct. 14, 2009 (JP) ..... 2009-236917

(51) Int. Cl.
*D05B 19/00* (2006.01)

(52) U.S. Cl.
USPC ..... 112/470.03

(58) Field of Classification Search
USPC ..... 112/102.5, 470.01, 470.03, 470.04, 112/470.06, 470.09, 470.14, 470.18, 112/475.19; 700/135, 137
See application file for complete search history.

(56) References Cited

U.S. PATENT DOCUMENTS

| | | | |
|---|---|---|---|
| 4,388,883 | A | 6/1983 | Hirota et al. |
| 4,403,559 | A | 9/1983 | Hirose |
| 4,860,675 | A | 8/1989 | Brower et al. |
| 4,860,678 | A | 8/1989 | Skogward |
| 4,936,233 | A | 6/1990 | Tajima et al. |
| 4,976,552 | A | 12/1990 | Ishikawa et al. |
| 5,218,916 | A | 6/1993 | Kurono et al. |
| 5,537,946 | A | 7/1996 | Sadeh et al. |
| 5,826,526 | A | 10/1998 | Tomita |

(Continued)

FOREIGN PATENT DOCUMENTS

| | | |
|---|---|---|
| JP | A-56-130181 | 10/1981 |
| JP | A-56-166887 | 12/1981 |

(Continued)

OTHER PUBLICATIONS

Office Action mailed Jan. 21, 2011, U.S. Appl. No. 12/071,784.

(Continued)

*Primary Examiner* — Tejash Patel
(74) *Attorney, Agent, or Firm* — Oliff PLC

(57) ABSTRACT

A sewing machine includes a transfer device that is adapted to move a work cloth, a sewing device that moves a needle bar up and down, a first operation device that outputs a first output signal in accordance with an operation state of the first operation device, a second operation device that outputs a second output signal in accordance with an operation state of the second operation device, a sewing data generation device that generates sewing data in accordance with the first output signal and the second output signal, a transfer control device that causes the work cloth to be moved by driving the transfer device in accordance with the sewing data, and a sewing control device that causes the unit stitch to be sewn on the work cloth by driving the sewing device in accordance with the sewing data.

14 Claims, 17 Drawing Sheets

(56) References Cited

U.S. PATENT DOCUMENTS

| | | | | |
|---|---|---|---|---|
| 5,836,260 | A | 11/1998 | Kawaguchi et al. | |
| 5,957,070 | A | 9/1999 | Yoshida et al. | |
| 6,161,491 | A | 12/2000 | Takenoya et al. | |
| 6,256,551 | B1 | 7/2001 | Muto | |
| 6,352,043 | B1 | 3/2002 | Tajima et al. | |
| 6,932,005 | B2 | 8/2005 | Tajima | |
| 7,069,870 | B2 | 7/2006 | Orii et al. | |
| 7,079,917 | B2 | 7/2006 | Taguchi et al. | |
| 7,239,935 | B2 | 7/2007 | Katagiri | |
| 7,460,925 | B2 | 12/2008 | Noguchi | |
| 7,715,940 | B2 | 5/2010 | Muto et al. | |
| 7,878,133 | B2 * | 2/2011 | Tokura et al. | 112/470.04 |
| 2003/0056702 | A1 | 3/2003 | Tamai | |
| 2006/0137582 | A1 | 6/2006 | Kawabe et al. | |
| 2008/0216721 | A1 | 9/2008 | Nagai et al. | |
| 2008/0216725 | A1 | 9/2008 | Tokura et al. | |
| 2008/0257240 | A1 | 10/2008 | Grufman et al. | |

FOREIGN PATENT DOCUMENTS

| | | |
|---|---|---|
| JP | A-1-99594 | 4/1989 |
| JP | A-3-143473 | 6/1991 |
| JP | A-5-245277 | 9/1993 |
| JP | A-6-240557 | 8/1994 |
| JP | A-9-10455 | 1/1997 |
| JP | B2-2733769 | 1/1998 |
| JP | A-10-146481 | 6/1998 |
| JP | B2-2904822 | 3/1999 |
| JP | B2-2953018 | 7/1999 |
| JP | A-2001-321587 | 11/2001 |
| JP | A-2005-193027 | 7/2005 |
| JP | A-2006-20664 | 1/2006 |
| JP | A-2006-26147 | 2/2006 |
| JP | A-2006-26148 | 2/2006 |
| JP | A-2006-26149 | 2/2006 |
| JP | A-2006-271799 | 10/2006 |
| JP | A-2008-246186 | 10/2008 |

OTHER PUBLICATIONS

Jun. 28, 2010 Office Action for U.S. Appl. No. 12/071,782.

Oct. 18, 2010 Notice of Allowance for U.S. Appl. No. 12/071,782.

Jun. 30, 2010 Office Action for U.S. Appl. No. 12/071,784.

Tsuneo Okuyama et al., U.S. Appl. No. 12/900,090, filed Oct. 7, 2010.

Masashi Tokura et al., U.S. Appl. No. 12/071,782, filed Feb. 26, 2008.

Masahiko Nagai et al., U.S. Appl. No. 12/071,784, filed Feb. 26, 2008.

Nov. 22, 2013 Office Action issued in U.S. Appl. No. 12/900,090.

* cited by examiner

FIG. 13

| | |
|---|---|
| STITCHING | 221 |
| -7.41 | |
| 7.17 | |
| STITCHING | 222 |
| 9.91 | |
| -2.83 | |
| STITCHING | 223 |
| 5.00 | |
| 8.66 | |

FIG. 16

| TRANSFER |
| --- |
| 5.00 |
| 8.66 |

231

SEWING MACHINE AND COMPUTER-READABLE MEDIUM STORING SEWING MACHINE CONTROL PROGRAM

CROSS-REFERENCE TO RELATED APPLICATION

This application claims priority to Japanese Patent Application No. 2009-236917, filed Oct. 14, 2009, the content of which is hereby incorporated herein by reference in its entirety.

BACKGROUND

The present disclosure relates to a sewing machine that includes a transfer device that moves a work cloth and a computer-readable medium that stores a sewing machine control program.

In recent years, in the field of quilting, free motion sewing has been performed in which stitches are sewn using a sewing machine while freely moving a work cloth by a user's manual operation. When free motion sewing is performed, a feed dog of the sewing machine does not protrude from an upper surface of a needle plate, and the feed dog does not feed the work cloth. It may be difficult for a user who is unfamiliar with free motion sewing to perform an operation to move the work cloth to a desired position. Therefore, stitches may not be formed in the desired position. To address this, a sewing machine has been proposed that has a function to perform free motion sewing by moving an embroidery frame, by which a work cloth is held, according to a user's command. With this type of sewing machine, the embroidery frame is moved based on an output signal in accordance with an operation state of an operation device such as a mouse, and stitches are formed. When a mouse is used as the operation device, a movement amount and a movement direction of the embroidery frame are respectively determined based on a movement amount and a movement direction of the mouse.

SUMMARY

In a known sewing machine, a straight stitch is set for a stitch formed by free motion sewing. Therefore, when a user desires to change the shape of the stitch, the user may have to specify the shape of the stitch using the operation device. Therefore, for example, in a case where the user desires to form a zigzag stitch by free motion sewing, the user may have to operate the operation device in accordance with the shape of the zigzag stitch. Accordingly, it may be difficult for the user to operate the operation device, so a desired stitch may be not formed by free motion sewing.

Various exemplary embodiments of the broad principles derived herein provide a sewing machine and a computer-readable medium storing a sewing machine control program that allow a desired shape of a stitch to be formed in free motion sewing by a simple operation.

Exemplary embodiments provide a sewing machine that includes a transfer device that is adapted to move a work cloth, and a sewing device that moves a needle bar, to a bottom end of which a needle can be attached, up and down. The sewing machine also includes a first operation device that outputs a first output signal in accordance with an operation state of the first operation device, and a second operation device that outputs a second output signal in accordance with an operation state of the second operation device. The first output signal specifies a type of a unit stitch formed by at least one stitch. The second output signal specifies a position where the unit stitch is sewn on the work cloth. The sewing machine further includes a sewing data generation device that generates sewing data in accordance with the first output signal and the second output signal, the sewing data including coordinate data that specify the position where the unit stitch is sewn, a transfer control device that causes the work cloth to be moved by driving the transfer device in accordance with the sewing data generated by the sewing data generation device, and a sewing control device that causes the unit stitch to be sewn on the work cloth by driving the sewing device in accordance with the sewing data generated by the sewing data generation device.

Exemplary embodiments also provide a computer-readable medium storing a control program executable on a sewing machine. The program includes instructions that cause a computer to perform the steps of receiving a first output signal that is output from a first operation device of the sewing machine and that specifies a type of a-unit stitch formed by at least one stitch, and receiving a second output signal that is output from a second operation device of the sewing machine and that specifies a position where the unit stitch is sewn on a work cloth. The program also includes instructions that cause the computer to perform the steps of generating sewing data in accordance with the first output signal and the second output signal, the sewing data including coordinate data that specify the position where the unit stitch is sewn, causing the work cloth to be moved by driving a transfer device in accordance with the generated sewing data, the transfer device being adapted to move the work cloth, and causing the unit stitch to be sewn on the work cloth by driving a sewing device in accordance with the generated sewing data, the sewing device moving a needle bar, to a bottom end of which a needle can be attached, up and down.

BRIEF DESCRIPTION OF THE DRAWINGS

Exemplary embodiments will be described below in detail with reference to the accompanying drawings in which:

FIG. 13 is an explanatory diagram that illustrates sewing data generated in the main processing;

FIG. 16 is an explanatory diagram that illustrates transfer data generated in the main processing.

DETAILED DESCRIPTION

Hereinafter, an embodiment will be explained in order with reference to the drawings. The drawings are used for explaining technical features that can be used in the present disclosure, and the device configuration, the flowcharts of various types of processing, and the like that are described are simply explanatory examples that does not limit the present disclosure to only the configuration, the flowcharts, and the like.

Figure 1:
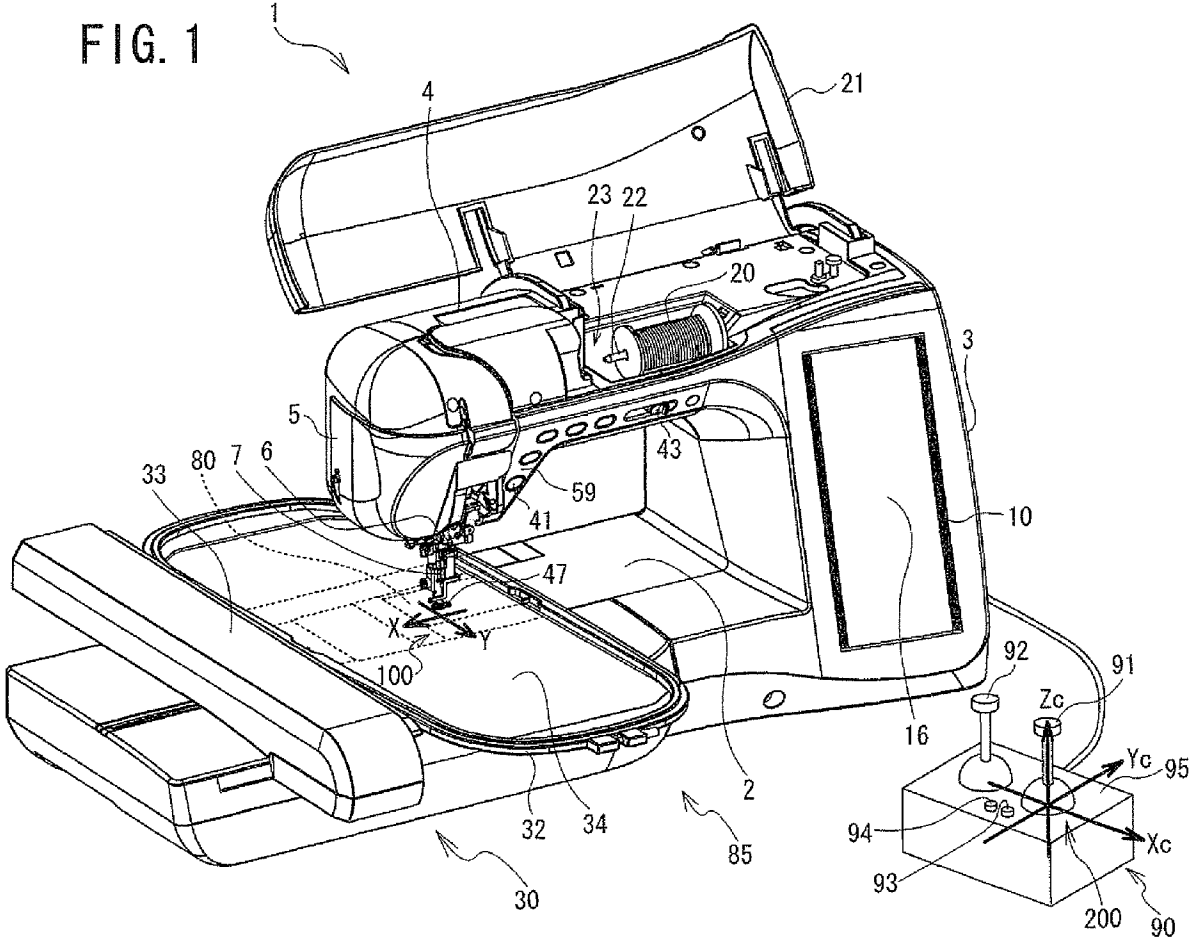
FIG. 1 is a perspective view of a sewing machine.

A physical configuration of a sewing machine 1 will be explained with reference to FIG. 1. In FIG. 1, a direction of an arrow X, an opposite direction of the arrow X, a direction of an arrow Y, and an opposite direction of the arrow Y are respectively referred to as a left direction, a right direction, a front direction, and a rear direction. As shown in FIG. 1, a main body 85 of the sewing machine 1 includes a bed 2, a pillar 3, and an arm 4. The long dimension of the bed 2 is the right-left direction. The pillar 3 extends upward from the right end of the bed 2. The arm 4 extends to the left from the upper end of the pillar 3. A head 5 is provided in the left end portion of the arm 4. A liquid crystal display (LCD) 10 is provided on a front surface of the pillar 3. A touch panel 16 is provided on a surface of the LCD 10. Input keys, which are used to input a sewing pattern and a sewing condition, and the like are displayed on the LCD 10. A user may select a sewing pattern, a sewing condition, or the like by touching a position of the touch panel 16 that corresponds to a position of an input key or the like that is displayed on the LCD 10 using the user's finger or a dedicated stylus pen. Hereinafter, an operation of touching the touch panel 16 is referred to as a "panel operation".

A feed dog (not shown in the drawings), a feed mechanism (not shown in the drawings), a pulse motor 78 (refer to FIG. 2), a shuttle (not shown in the drawings), a shuttle mechanism (not shown in the drawings), and a lower shaft (not shown in the drawings) are accommodated within the bed 2. The feed dog feeds a work cloth. The feed mechanism drives the feed dog in a front-rear direction and in an up-down direction. The pulse motor 78 adjusts a feed amount of the work cloth (not shown in the drawings) by the feed dog. The shuttle may accommodate a bobbin (not shown in the drawings) on which a lower thread (not shown in the drawings) is wound. The lower shaft drives the shuttle mechanism, which rotates the shuttle. The lower shaft is rotated in synchronization with a drive shaft (not shown in the drawings) by rotation of the drive shaft transmitted via a timing belt (not shown in the drawings). A needle plate 80 is provided on a top surface of the bed 2. An embroidery unit 30 may be attached to the left end of the bed 2. When the embroidery unit 30 is not used, a side table (not shown in the drawings) may be attached to the left end of the bed 2. When the embroidery unit 30 is attached to the left end of the bed 2, the embroidery unit 30 is electrically connected to the sewing machine 1. At this time, the feed dog is held in a retracted position below the needle plate 80. The embroidery unit 30 will be described in more detail below.

A sewing machine motor 79 (refer to FIG. 2), the drive shaft, a needle bar 6, a needle bar up-down movement mechanism (not shown in the drawings) and a needle bar swinging mechanism (not shown in the drawings) are accommodated within the pillar 3 and the arm 4. A needle 7 may be attached to the lower end of the needle bar 6. The sewing machine motor 79 rotates the drive shaft via the timing belt (not shown in the drawings). The needle bar up-down movement mechanism is driven by the drive shaft, and thereby the needle bar 6 is moved up and down. The needle bar swinging mechanism moves the needle bar 6 in the right-left direction using a pulse motor 77 (refer to FIG. 2) as a drive source. A presser bar (not shown in the drawings), which extends in the up-down direction, is provided at the rear of the needle bar 6. A presser holder (not shown in the drawings) is fixed to the lower end of the presser bar. A presser foot 47, which presses the work cloth (not shown in the drawings), may be attached to the presser holder.

A top cover 21 is provided in the longitudinal direction of the arm 4. The top cover 21 is axially supported at the rear upper edge of the arm 4 such that the top cover 21 may be opened and closed around the right-left directional shaft. A thread spool housing 23 is provided close to the middle of the top of the arm 4 under the top cover 21. The thread spool housing 23 is a recessed portion for accommodating a thread spool 20 that supplies a thread to the sewing machine 1. A spool pin 22, which projects toward the head 5, is provided on an inner face of the thread spool housing 23 on the pillar 3 side. The thread spool 20 may be attached to the spool pin 22 when the spool pin 22 is inserted through the insertion hole (not shown in the drawings) that is formed in the thread spool 20. Although not shown in the drawings, the thread of the thread spool 20 may be supplied as an upper thread to the needle 7 through a plurality of thread guide portions (not shown in the drawings) provided on the head 5. The sewing machine 1 includes, as the thread guide portions, a tensioner (not shown in the drawings), a thread take-up spring (not shown in the drawings), and a thread take-up lever (not shown in the drawings), for example. The tensioner and the thread take-up spring adjust the thread tension of the upper thread. The thread take-up lever is driven reciprocally up and down and pulls the upper thread up. The needle 7, the thread take-up lever, and the shuttle are driven in synchronization, and thereby a stitch is formed on the work cloth by the upper thread and the lower thread.

A pulley (not shown in the drawings) is provided on a right side surface of the pillar 3. The pulley is used to manually rotate the drive shaft (not shown in the drawings). The pulley causes the needle bar 6 to be moved up and down. A joystick 90, which is provided separately from the main body 85, is connected to the right side surface of the pillar 3. The joystick 90 includes a first lever 91, a second lever 92, a first button 93, a second button 94, and a box 95. The first lever 91 and the second lever 92 are bar-shaped operation members that are held by the cuboid box 95. The first lever 91 and the second lever 92 can be tilted to a direction through 360 degrees. The first button 93 and the second button 94 are circular when viewed in a plan view. During execution of normal processing, the joystick 90 functions as an operation device to input a command in a similar manner to the touch panel 16. On the other hand, as described below, during execution of main processing in which free motion sewing is performed, the joystick 90 is used to instruct a movement direction and a movement distance (a movement amount) of an embroidery frame 32 in accordance with a tilting operation of the first lever 91. An output signal that is output from the joystick 90 will be described in detail below.

A front cover 59 is provided on a front surface of the head 5 and the arm 4. A sewing start/stop switch 41, a speed controller 43, and other operation switches are provided on the front cover 59. The sewing start/stop switch 41 is used to issue a command to start or stop sewing. If the sewing start/stop switch 41 is pressed when the sewing machine 1 is stopped, the operation of the sewing machine 1 is started. If the sewing start/stop switch 41 is pressed when the sewing machine 1 is operating, the operation of the sewing machine 1 is stopped. The speed controller 43 is used to adjust the rotation speed of the drive shaft (not shown in the drawings).

The embroidery unit 30 will be explained with reference to FIG. 1. The embroidery unit 30 includes the embroidery frame 32, a carriage (not shown in the drawings), a carriage cover 33, a front-rear movement mechanism (not shown in the drawings), and a right-left movement mechanism (not shown in the drawings). The embroidery frame 32 may hold a work cloth 34. The carriage may detachably support the embroidery frame 32. A groove portion (not shown in the drawings), in which the embroidery frame 32 may be attached, is provided on the right side of the carriage. The groove portion extends in the longitudinal direction of the carriage. The carriage cover 33 generally has a rectangular parallelepiped shape that is long in the front-rear direction. The carriage cover 33 accommodates the carriage. The front-rear movement mechanism (not shown in the drawings) is provided inside the carriage cover 33. The front-rear movement mechanism moves the carriage, to which the embroidery frame 32 may be attached, in the front-rear direction (Y axis direction) using a Y axis motor 82 (refer to FIG. 2) as a drive source. The right-left movement mechanism is provided inside a main body of the embroidery unit 30. The right-left movement mechanism moves the carriage, to which the embroidery frame 32 may be attached, the front-rear movement mechanism, and the carriage cover 33 in the right-left direction (X axis direction) using an X axis motor 81 (refer to FIG. 2) as a drive source. Control signals to the Y axis motor 82 and the X axis motor 81 are output by a CPU 61 (refer to FIG. 2) that will be described below. The size of the embroidery frame 32 is not limited to that shown in FIG. 1. Although not shown in the drawings, a variety of sizes of embroidery frames may be prepared.

Figure 2:
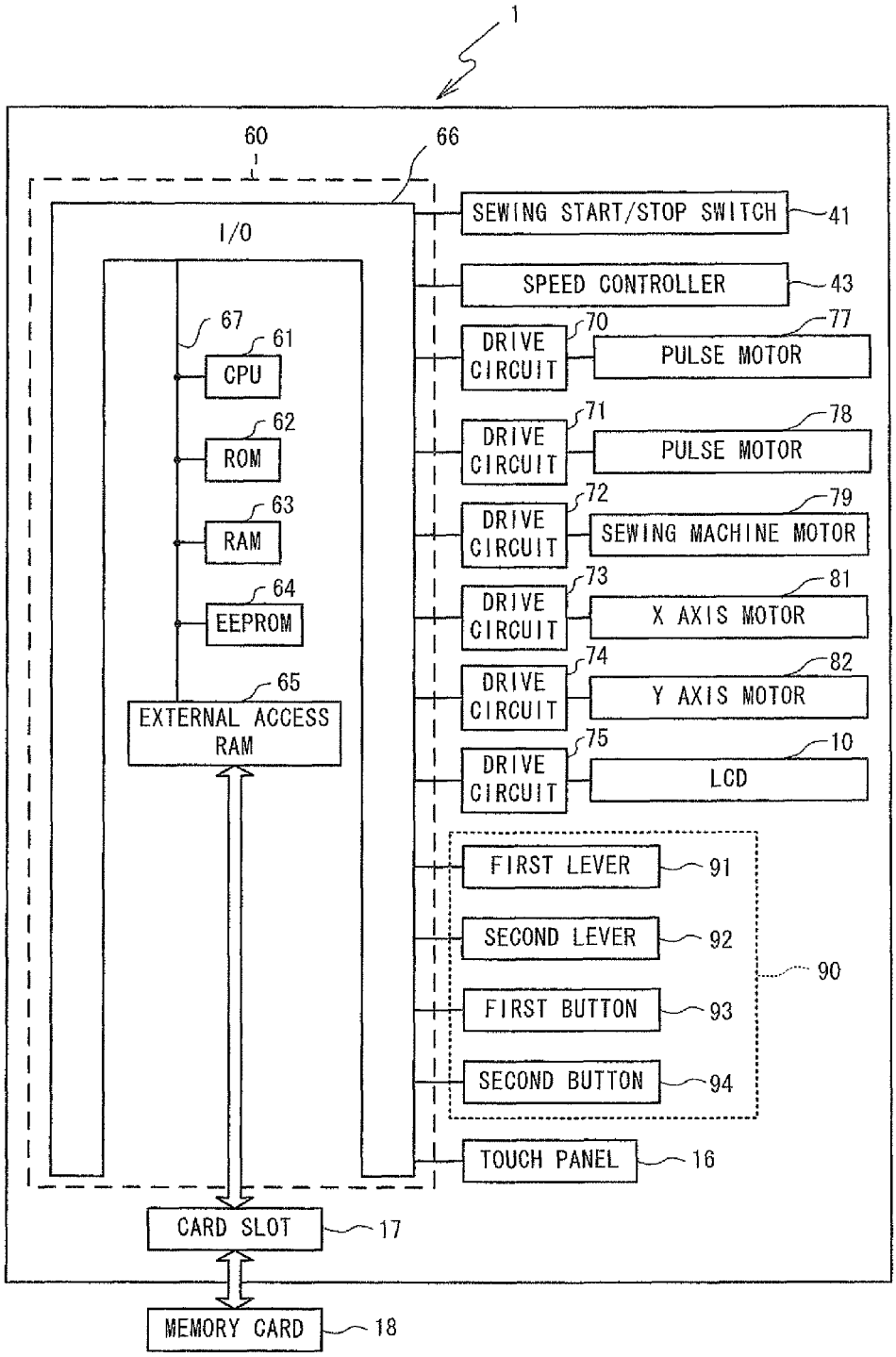
FIG. 2 is a block diagram that shows an electrical configuration of the sewing machine.

A main electrical configuration of the sewing machine 1 will be explained with reference to FIG. 2. As shown in FIG. 2, a control portion 60 of the sewing machine 1 includes the CPU 61, a ROM 62, a RAM 63, an EEPROM 64, an external access RAM 65, and an input/output interface 66, which are connected to one another via a bus 67.

The CPU 61 conducts main control over the sewing machine 1, and performs various types of computation and processing in accordance with programs stored in the ROM 62 and the like. The ROM 62 includes a plurality of storage areas including a program storage area and a unit data storage area. The program storage area stores a plurality of programs including a mode setting program and a main program, which are executed by the CPU 61. The mode setting program is a program for executing mode setting processing that will be described below. The main program is a program for executing the main processing that will be described below. The unit data storage area stores a plurality of types of unit data. The unit data are data for sewing a unit stitch. The unit stitch is a minimum unit of a stitch formed by at least one stitch. In the present embodiment, data including single stitch data for sewing a running stitch and two stitch data for sewing a zigzag stitch are stored as the unit data in the unit data storage area. The unit data will be described in more detail below.

The RAM 63 is a storage element that can be read from and written to as desired. The RAM 63 stores, for example, computation results obtained when various types of programs stored in the program storage area are executed. The EEPROM 64 is a storage element that can be read from and written to. The EEPROM 64 stores various parameters that are used when various types of programs stored in the program storage area are executed. A card slot 17 is connected to the external access RAM 65. The card slot 17 can be connected to a memory card 18. It is possible to read and write information from and to the memory card 18 by connecting the card slot 17 and the memory card 18.

The sewing start/stop switch 41, the speed controller 43, drive circuits 70 to 75, the joystick 90, and the touch panel 16 are connected to the input/output interface 66. The drive circuit 70 drives the pulse motor 77. The pulse motor 77 is a drive source of the needle bar swinging mechanism (not shown in the drawings). The drive circuit 71 drives the pulse motor 78 for adjusting a feed amount. The drive circuit 72 drives the sewing machine motor 79. The sewing machine motor 79 is a drive source of the drive shaft (not shown in the drawings). The drive circuit 73 to 75 respectively drives the X axis motor 81, the Y axis motor 82, and the LCD 10. The joystick 90 outputs an output signal that corresponds to an operation member to the control portion 60 via the input/output interface 66. As described above, the joystick 90 includes the first lever 91, the second lever 92, the first button 93, and the second button 94 as the operation members. Another element (not shown in the drawings) may be connected to the input/output interface 66 as appropriate.

The unit data stored in the ROM 62 will be explained below. The unit data include a stitch number m and m sets of initial coordinate data. The stitch number m indicates the number of stitches that form a unit stitch. The m sets of initial coordinate data are used for generating coordinate data to specify a relative position of a stitch that forms the unit stitch. The initial coordinate data include initial X coordinate data and initial Y coordinate data, which are represented by relative coordinates of an embroidery coordinate system 100 (refer to FIG. 1). The embroidery coordinate system 100 is a coordinate system that defines the drive amounts of the X axis motor 81 and the Y axis motor 82, which move the carriage (not shown in the drawings). The right-left direction and the front-rear direction of the sewing machine 1 are the X axis direction and the Y axis direction, respectively, in the embroidery coordinate system 100. An origin point of the embroidery coordinate system 100 is assumed as a rear left corner of a rectangular embroidery area that is set within the embroidery frame 32. The sewing direction is opposite to the moving direction of the embroidery frame 32. For example, when the stitch forming direction is a direction from the front to the rear of the sewing machine 1, the embroidery frame 32 is moved in a direction from the rear to the front of the sewing machine 1.

Figure 3:
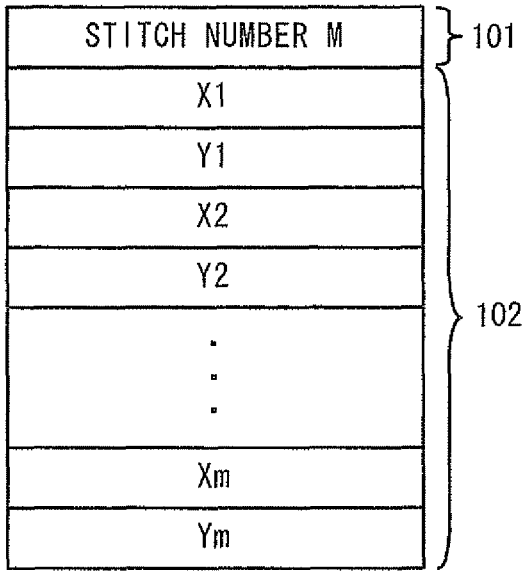
FIG. 3 is an explanatory diagram of unit data.
Figure 4:
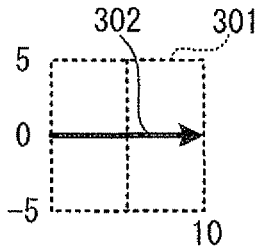
FIG. 4 is an explanatory diagram of a unit stitch for a running stitch.
Figure 5:
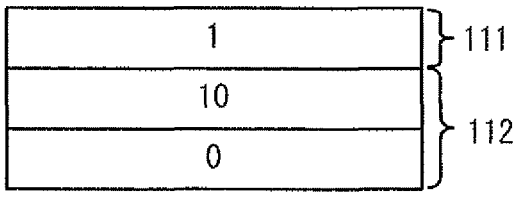
FIG. 5 is an explanatory diagram of unit data of the running stitch.
Figure 6:
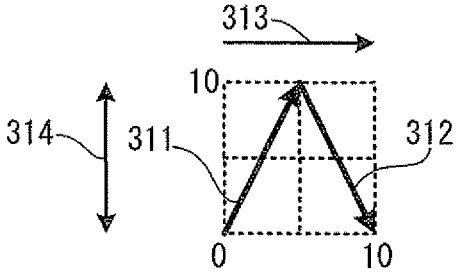
FIG. 6 is an explanatory diagram of a unit stitch for a zigzag stitch.
Figure 7:
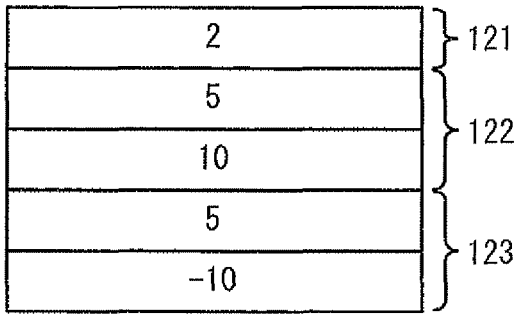
FIG. 7 is an explanatory diagram of unit data of the zigzag stitch.

As shown in FIG. 3, the stitch number m is set as a first data piece 101 of the unit data. As data 102, which are a second data piece and a following data piece, m sets of the initial X coordinate data and the initial Y coordinate data are set. Examples of the unit stitch and the unit data will be explained using a running stitch and a zigzag stitch as examples. As shown in FIG. 4, the unit stitch for forming a running stitch is a single stitch that is represented by a vector 302. In FIG. 4, a grid 301 denoted by dashed lines indicates a relative coordinate system where one unit is 0.1 mm. In the relative coordinate system shown in FIG. 4, the right-left direction and the up-down direction of the page respectively correspond to the X axis direction and the Y axis direction in the embroidery coordinate system. The grid 301 is not sewn. The length of the vector 302 indicates the length of the stitch. The direction indicated by the vector 302 indicates the direction of forming of the stitch. As shown in FIG. 5, the unit data of the unit stitch for sewing the running stitch include data 111 indicating a stitch number of 1, and a set of initial coordinate data 112 (the initial X coordinate data and the initial Y coordinate data). The initial coordinate data 112 is expressed by numbers that are set such that one unit is 0.1 mm. In a similar manner, as shown in FIG. 6, the unit stitch for forming a zigzag stitch includes two stitches that are represented by vectors 311 and 312. In FIG. 6, arrows 313 and 314 respectively indicate a feed direction and a width direction of the zigzag stitch. The feed direction indicated by the arrow 313 is orthogonal to the width direction indicated by the arrow 314. As shown in FIG. 7, the unit data of the unit stitch for sewing the zigzag stitch include data 121 indicating a stitch number of 2, and two sets of initial coordinate data 122 and 123.

Figure 8:
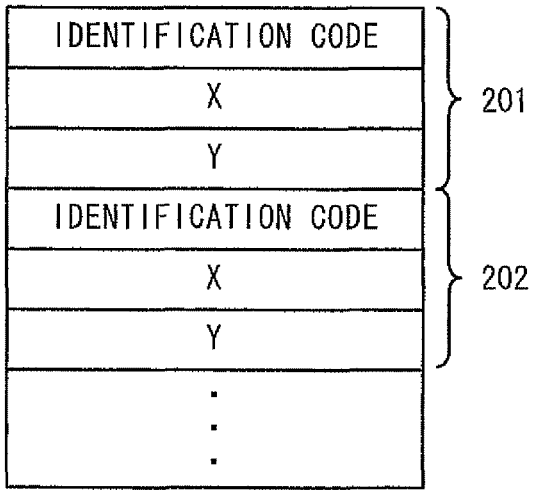
FIG. 8 is an explanatory diagram of sewing data.

Sewing data that are generated in accordance with an operation state of the joystick 90 will be explained with reference to FIG. 8. As shown in FIG. 8, the sewing data are data in which a combination of an identification code and coordinate data is set as one unit, and are shown as data 201 and 202, for example. The identification code defines types of control relating to sewing. For example, stitching, transfer, color change, thread cutting, and temporary stop may be used as the identification code. The coordinate data are represented by relative coordinates in the embroidery coordinate system 100 (refer to FIG. 1) with respect to a current needle drop position. The coordinate data are data for specifying the movement direction and the movement amount of the embroidery frame 32. The needle drop position is a position at which a needle 7 pierces the work cloth 34 that is held by the embroidery frame 32.

Figure 9:
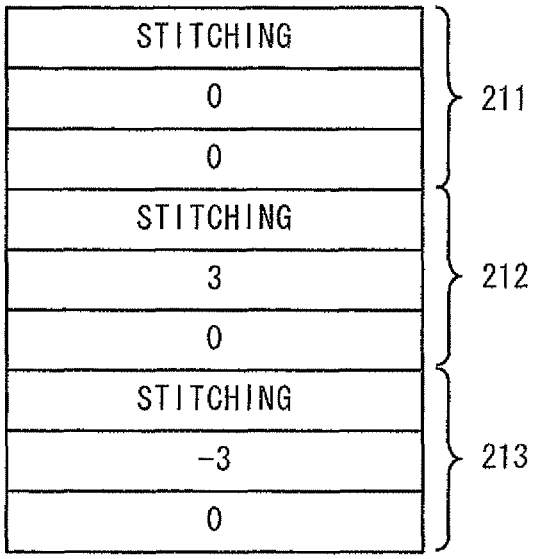
FIG. 9 is an explanatory diagram of sewing data of reinforcement stitches.

Sewing data for forming reinforcement stitches (hereinafter referred to as "reinforcement stitch data") will be explained with reference to FIG. 9. In a case where stitches are formed on a work cloth, reinforcement stitches are generally formed at a start point and an end point of the stitches to prevent a thread from getting loose. In the present embodiment, three stitches are sewn very closely together as the reinforcement stitches. For example, data that are shown in FIG. 9 and stored in ROM 62 are used as the reinforcement stitch data. As shown in FIG. 9, the reinforcement stitch data of the present embodiment include the sewing data represented by data 211 to 213 for three stitches.

An output signal in accordance with an operation state of each of the operation members included in the joystick 90 will be explained. Each of the first lever 91 and the second lever 92 outputs an output signal in accordance with a tilt direction and a tilt amount (an angle) of each of the levers 91 and 92 to the control portion 60. The output signal of the first lever 91 of the present embodiment includes vector data (x, y) of a coordinate system 200 of the first lever 91 shown in FIG. 1. In the coordinate system 200, a Zc axis overlaps the extending direction of the first lever 91 in a non-operated state. An Xc axis passes through a point at which the Zc axis intersects a top surface of the box 95, and is set in parallel with a long side of the top surface of the box 95. A Yc axis passes through the point at which the Zc axis intersects the top surface of the box 95, and is set in parallel with a short side of the top surface of the box 95. An origin point of the coordinate system 200 serves as the center of rotation when a tilting operation of the first lever 91 is performed.

A tilt direction θ is expressed by an angle between a vector on the Xc axis extending from the origin point of the coordinate system 200 to the plus side of the Xc axis (in the direction of the arrow indicating the Xc axis) on an Xc-Yc plane and a line obtained by projecting the extending direction of the first lever 91 from the plus side of the Zc axis (from above the box 95) onto the Xc-Yc plane. The tilt direction θ is expressed such that a counterclockwise angle is a plus angle. The tilt direction 0 is obtained as $\theta=\tan^{-1}(y/x)$ using vector data. A tilt amount T is expressed by a step value that is determined in accordance with an angle between the extending direction of the first lever 91 and a vector on the Zc axis extending from the origin point of the coordinate system 200 to the plus side of the Zc axis. The tilt amount T of the present embodiment takes one of 128 step values from 0 to 127. Specifically, the tilt amount T corresponds to the length of the vector expressed by the vector data, and is obtained as $T=\sqrt{(x^2+y^2)}$. The output signal of the second lever 92 includes vector data similar to the vector data of the first lever 91. Each of the first button 93 and the second button 94 outputs an output signal in accordance with whether each of the buttons 93 and 94 is operated to the control portion 60 (refer to FIG. 2).

Figure 10:
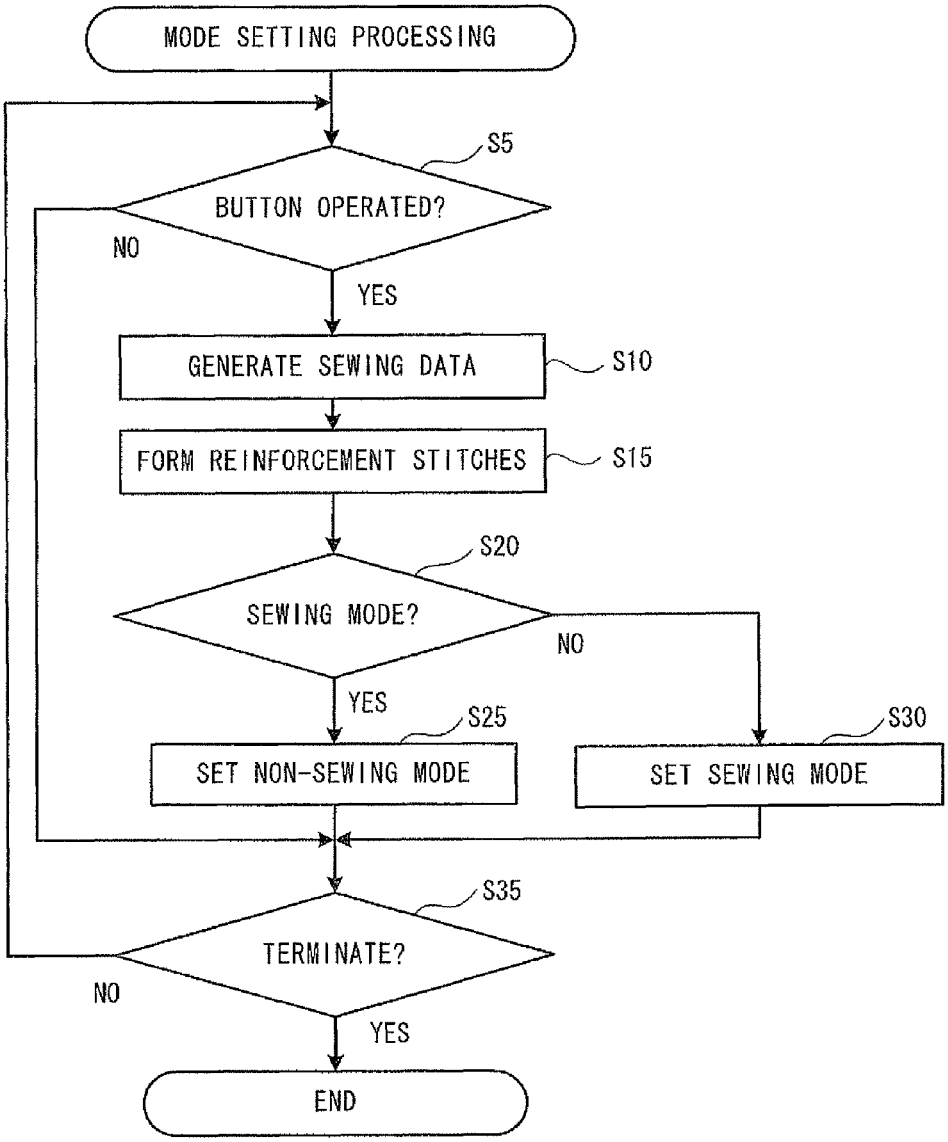
FIG. 10 is a flow chart of mode setting processing.
Figure 11:
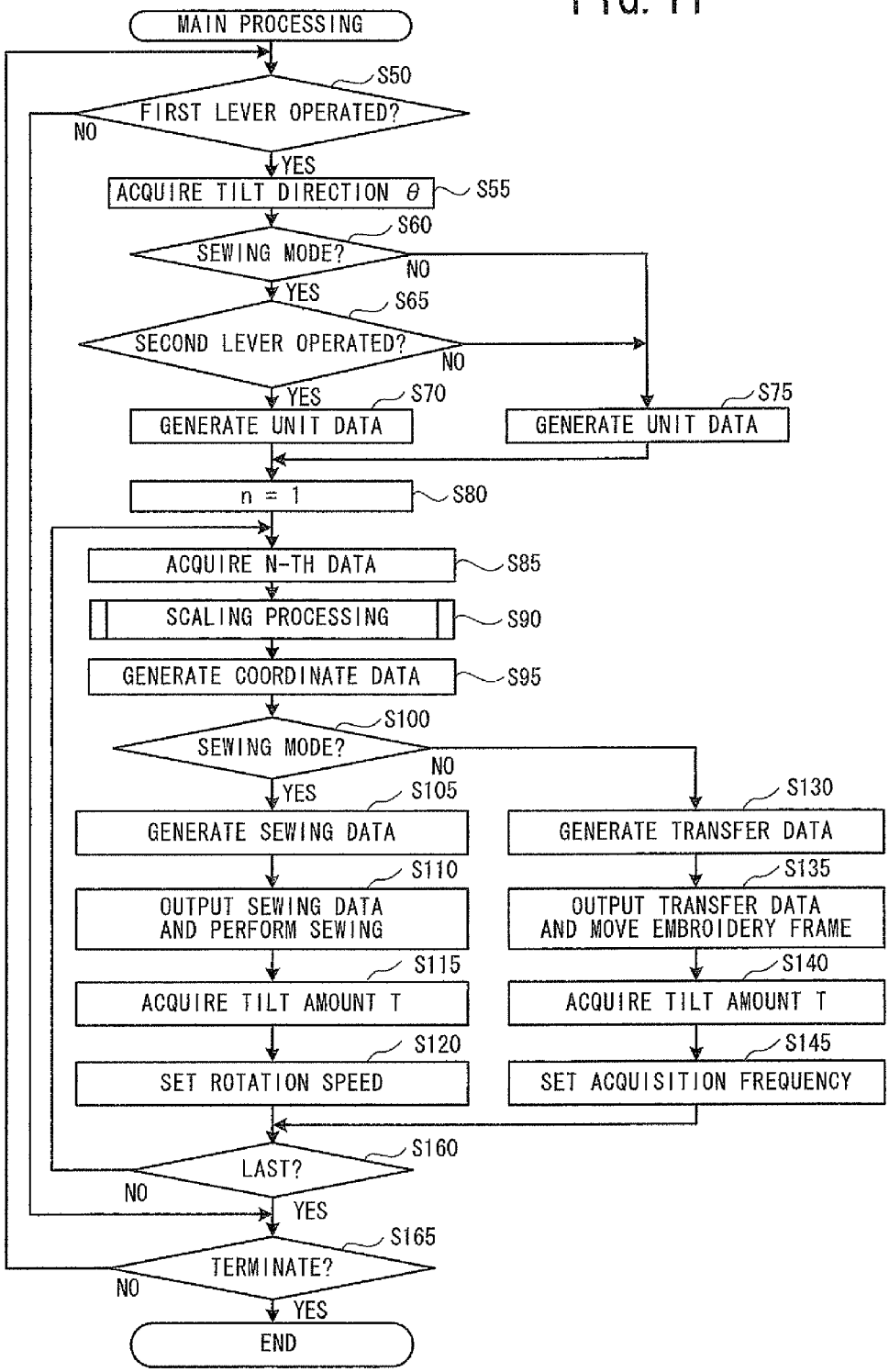
FIG. 11 is a flowchart of main processing.

An overview of processing when free motion sewing is performed will be explained. When free motion sewing is performed, the mode setting processing shown in FIG. 10 and the main processing shown in FIG. 11 are performed in the sewing machine 1. In the mode setting processing, the operation mode of the sewing machine 1 is set to one of a sewing mode and a non-sewing mode in accordance with an operation of the first button 93. In the main processing, one of free motion sewing and transfer of the embroidery frame 32 is performed in accordance with a tilting operation of the first lever 91. If the sewing mode has been set as the operation mode, free motion sewing is performed in the sewing machine 1 in accordance with the tilting operation of the first lever 91. If the non-sewing mode has been set as the operation mode, in the sewing machine 1, the embroidery frame 32 is moved in accordance with the tilting operation of the first lever 91.

In the sewing machine 1, the type of stitches formed by free motion sewing is set to one of a running stitch and a zigzag stitch in accordance with whether the second lever 92 has been operated. Specifically, if the second lever 92 has not been operated, the running stitch is set as the stitch type. If the second lever 92 has been operated, the zigzag stitch is set as the stitch type. In the sewing machine 1, at least one of the size in the width direction and the size in the feed direction of the zigzag stitch is changed in accordance with the output signal of the second lever 92 in a certain case in scaling processing (which will be described below). The certain case is a case in which "activated" is set for at least one of "size change in the width direction" and "size change in the feed direction". The "size change in the width direction" indicates whether the size in the width direction of the zigzag stitch is to be changed. The "size change in the feed direction" indicates whether the size in the feed direction of the zigzag stitch is to be changed. Settings of the "size change in the width direction" and the "size change in the feed direction" are performed based on a panel operation, for example, and the settings are stored in the EEPROM 64.

The scale ratio in the width direction and the feed direction in the scaling processing is determined based on vector data (x, y) included in the output signal output from the second lever 92 and on a ratio setting table stored in the EEPROM 64. The ratio setting table stores an associated relationship between the vector data (x, y) and the scale ratio. In the present embodiment, a ratio of 0 to 40 times is set depending on the vector data. Specifically, in the sewing machine 1, when a value of x is positive, the size in the width direction of the zigzag stitch is enlarged by a ratio corresponding to the value of x. When the value of x is negative, the size in the width direction of the zigzag stitch is reduced by the ratio corresponding to the value of x. In the same manner, in the sewing machine 1, when a value of y is positive, the size in the feed direction of the zigzag stitch is enlarged by a ratio corresponding to the value of y. When the value of y is negative, the size in the feed direction of the zigzag stitch is reduced by the ratio corresponding to the value of y. When a command to perform free motion sewing is input, the mode setting processing shown in FIG. 10 and the main processing shown in FIG. 11 are respectively performed by the CPU 61 in accordance with the programs stored in the ROM 62. The command to perform free motion sewing may be input by a panel operation, for example.

The mode setting processing shown in FIG. 10 will be explained. As shown in FIG. 10, in the mode setting processing, first, a determination is made as to whether the first button 93 has been operated (step S5). It is determined whether the first button 93 has been operated based on the output signal that is output from the first button 93 to the control portion 60. In the present embodiment, the output signal that is output when the first button 93 has been operated is acquired as a control command. The control command is a command to start or terminate control of the sewing machine motor 79. The operation mode of the sewing machine 1 is switched in accordance with the control command.

If the first button 93 has not been operated (no at step S5), processing at step S35 (which will be described below) is performed. If the first button 93 has been operated (yes at step S5), the reinforcement stitch data are generated (step S10). The generated reinforcement stitch data are stored in the RAM 63. The reinforcement stitch data are generated every time the operation mode of the sewing machine 1 is switched by the processing at step S10 being performed. In the processing at step S10, the reinforcement stitch data are generated based on the reinforcement stitch data (refer to FIG. 9) stored in the ROM 62. Next, based on the reinforcement stitch data generated at step S10, reinforcement stitches are formed on the work cloth 34 (step S15). Specifically, a control signal is output to the drive circuits 73 and 74 in accordance with the reinforcement stitch data generated at step S10, so that the embroidery frame 32 is moved. A control signal is also output to the drive circuit 72, so that the needle bar 6 is driven up and down.

The EEPROM 64 is referred to, and a determination is made as to whether the sewing mode has been set as a current operation mode of the sewing machine 1 (step S20). If the sewing mode has been set as the operation mode (YES at step S20), the non-sewing mode is set as the operation mode (step S25). If the non-sewing mode has been set as the operation mode (NO at step S20), the sewing mode is set as the operation mode (step S30). The set operation mode is stored in the EEPROM 64.

When the first button 93 has not been operated (NO at step S5), when the non-sewing mode has been set as the operation mode (step S25), or when the sewing mode has been set as the operation mode (step S30), a determination is made as to whether a command to terminate processing in free motion sewing has been input (step S35). The command to terminate the processing in free motion sewing is input by a panel operation, for example. If the command to terminate the processing has not been input (NO at step S35), the processing returns to step S5. If the command to terminate the processing has been input (YES at step S35), the mode setting processing is terminated.

The main processing shown in FIG. 11 will be explained. As shown in FIG. 11, in the main processing, first, a determination is made as to whether the first lever 91 has been operated (step S50). It is determined whether the first lever 91 has been operated based on the output signal that is output from the first lever 91 to the control portion 60. If the first lever 91 has not been operated (NO at step S50), processing at step S165 (which will be described below) is performed. If the first lever 91 has been operated (YES at step S50), the tilt direction θ of the first lever 91 is acquired (step S55). The acquired tilt direction θ is stored in the RAM 63. As described above, the tilt direction θ is acquired based on the output signal output from the first lever 91 to the control portion 60.

The EEPROM 64 is referred to, and a determination is made as to whether the operation mode of the sewing machine 1 is the sewing mode (step S60). The operation mode of the sewing machine 1 is set in the above-described mode setting processing. If the operation mode of the sewing machine 1 is the sewing mode (YES at step S60), a determination is made as to whether the second lever 92 has been operated (step S65). It is determined whether the second lever 92 has been operated based on the output signal that is output from the second lever 92 to the control portion 60. If the second lever 92 has been operated (YES at step S65), the unit data for forming the zigzag stitch shown in FIG. 7 are generated (step S70). When the operation mode of the sewing machine 1 is the non-sewing mode (NO at step S60) or when the second lever 92 has not been operated (NO at step S65), the unit data for forming the running stitch shown in FIG. 5 are generated (step S75). In the processing at step S70 and step S75, the unit data corresponding to the stitch type are generated based on the unit data stored in the ROM 62. The generated unit data are stored in the RAM 63.

When the unit data are generated (step S70 or step S75), 1 is set as a parameter n (step S80). The parameter n is stored in the RAM 63. Next, nth initial coordinate data are acquired which are included in the unit data generated in the processing at one of step S70 and step S75 (step S85). The acquired initial coordinate data are stored in the RAM 63. For example, in a case where the unit data shown in FIG. 7 are generated in the processing at step S70, the first initial coordinate data 122 are acquired as the n-th initial coordinate data since the current parameter n is 1. For example, in a case where the unit data shown in FIG. 5 are generated in the processing at step S75, the first initial coordinate data 112 are acquired as the n-th initial coordinate data since the current parameter n is 1.

Figure 12:
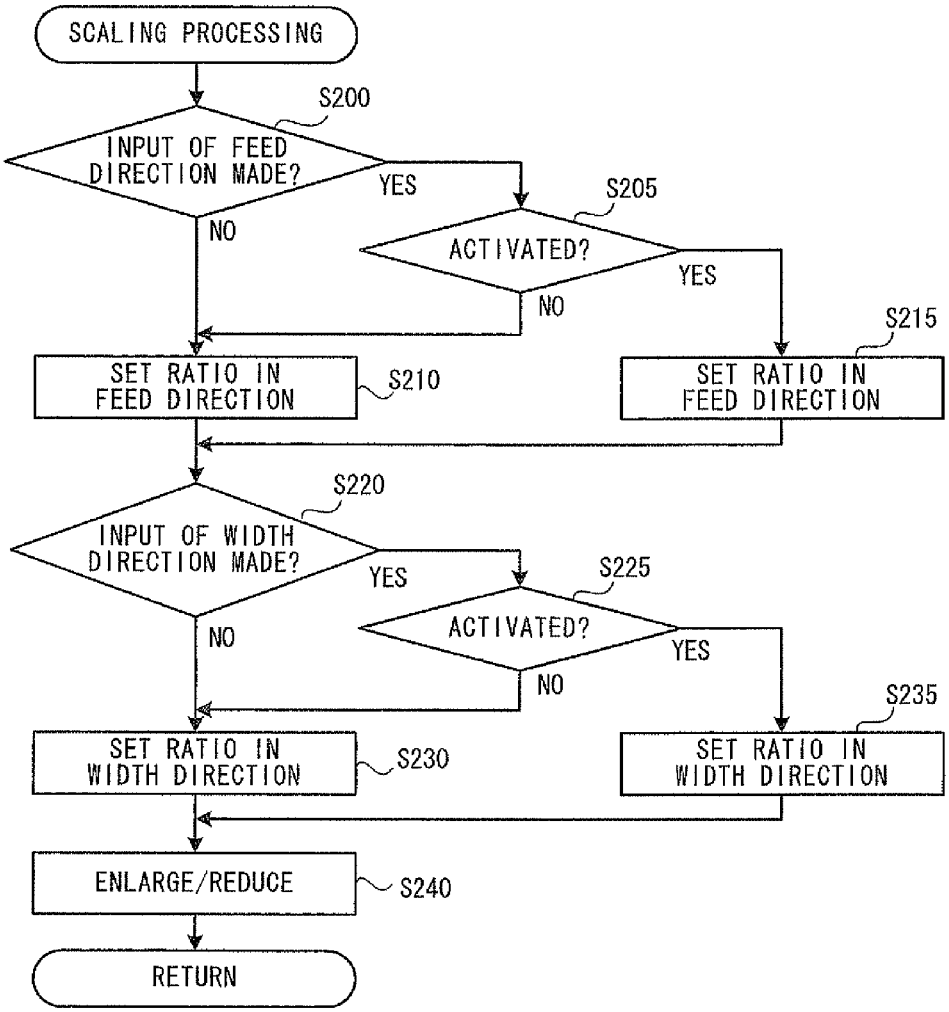
FIG. 12 is a flowchart of scaling processing that is performed in the main processing.

In accordance with the output signal output from the second lever 92, the scaling processing is performed on data (Xn, Yn) acquired at step S85 (step S90). Data (X'n, Y'n) acquired by the scaling processing are stored in the RAM 63. The scaling processing will be explained in detail with reference to FIG. 12. As shown in FIG. 12, in the scaling processing, first, a determination is made as to whether an input of the feed direction has been made based on the output signal that is output from the second lever 92 to the control portion 60 (step S200). In a case where the value of y of vector data included in the output signal is not 0, it is determined that the input of the feed direction has been made (YES at step S200). If the input of the feed direction has been made (YES at step S200), the EEPROM 64 is referred to and a determination is made as to whether the "size change in the feed direction" is activated (step S205). If the "size change in the feed direction" is activated (YES at step S205), the ratio of the size in the feed direction is set (step S215). Specifically, the ratio in the feed direction is set based on the value of y of the vector data included in the output signal and on the ratio setting table stored in the EEPROM 64. The set ratio is stored in the RAM 63. When the input of the feed direction has not been made (NO at step S200) or when the "size change in the feed direction" is not activated (NO at step S205), an initial value is set as the ratio of the size in the feed direction (step S210). The set ratio is stored in the RAM 63. The initial value set in the present embodiment is 1.

When the ratio of the size in the feed direction has been set (step S210 or step S215), a determination is made as to whether an input of the width direction has been made based on the output signal that is output from the second lever 92 to the control portion 60 (step S220). In a case where the value of x of the vector data included in the output signal is not 0, it is determined that the input of the width direction has been made (YES at step S220). If the input of the width direction has been made (YES at step S220), the EEPROM 64 is referred to and a determination is made as to whether the "size change in the width direction" is activated (step S225). If the "size change in the width direction" is activated (YES at step S225), the ratio of the size in the width direction is set (step S235). Specifically, the ratio in the width direction is set based on the value of x of the vector data included in the output signal and on the ratio setting table stored in the EEPROM 64. The set ratio is stored in the RAM 63. When the input of the width direction has not been made (NO at step S220), or when the "size change in the width direction" is not activated (NO at step S225), an initial value is set as the ratio of the size in the width direction (step S230). The set ratio is stored in the RAM 63. The initial value set in the present embodiment is 1.

At least one of the enlargement processing and the reduction processing is performed on the data (Xn, Yn) acquired in the processing at step S85 shown in FIG. 11 (step S240). The data (Xn', Yn') on which at least one of the enlargement processing and the reduction processing has been performed is stored in the RAM 63. The data (Xn' Yn') is obtained as (Xn', Yn') (Xn×(ratio in the feed direction), Yn×(ratio in the width direction)). A case is assumed where the ratio in the feed direction is set to 0.5 in the processing at step S215 and the ratio in the width direction is set to 1 in the processing at step S235 in the following three examples. A first example is considered where initial coordinate data 122 shown in FIG. 7 are acquired in the processing at step S85. In the first example, (2.5, −10) is obtained as (X1', Y1'). A second example is considered where initial coordinate data 123 shown in FIG. 7 are acquired in the processing at step S85. In the second example, (2.5, −10) is obtained as (X2', Y2'). A third example is considered where the second lever 92 is not operated in the processing at step S65 (NO at step S65) and then unit data are generated. In the third example, neither the input of the feed direction nor the input of the width direction has been made (NO at step S200, step S210, NO at step S220, step S230). Therefore, in the third example, (10, 0) is obtained as (X1', Y1'). When at least one of the enlargement processing and the reduction processing is performed (step S240), the scaling processing is terminated and the CPU 61 returns to the main processing shown in FIG. 11.

When the scaling processing at step S90 is terminated, the data (Xn', Yn'), on which at least one of the enlargement processing and reduction processing has been performed in the processing at step S90, is converted to coordinate data based on the tilt direction θ acquired in the processing at step S55. The coordinate data (Xn", Yn") generated by the conversion processing are stored in the RAM 63 (step S95). In the above-described first example, when 60 degrees is acquired as the tilt direction θ in the processing at step S55, (−7.41, 7.17) is obtained as (X1", Y1") based on the equation (X1", Y1")=(X1' cos θ−Y1' sin θ, X1' sin θ+Y1' cos θ). In the above-described second example, when 60 degrees is acquired as the tilt direction θ in the processing at step S55, (9.91, −2.83) is obtained as (X2", Y2") based on the equation (X2", Y2")=((X1'+X2')cos θ−(Y1'+Y2')sin θ, (X1'+X2')sin θ+(Y1'+Y2')cos θ)−(X1", Y1"). In the above-described third example, when 60 degrees is acquired as the tilt direction θ in the processing at step S55, (5, 8.66) is obtained as (X1", Y1") in the same manner as the first example.

A determination is made as to whether the operation mode of the sewing machine 1 is the sewing mode (step S100). The processing performed when the operation mode of the sewing machine 1 is the non-sewing mode (NO at step S100) will be described below. If the operation mode of the sewing machine 1 is the sewing mode (YES at step S100), the sewing data are generated (step S105). The generated sewing data are stored in the RAM 63. The sewing data are generated by adding an identification code to the coordinate data converted in the processing at step S95. For example, sewing data 221 shown in FIG. 13 are generated by adding an identification code "stitching" to the coordinate data (X1", Y1") of the above-described first specific example. In the same manner, sewing data 222 and sewing data 223 are generated by adding the identification code "stitching" to the coordinate data of the second example and to the coordinate data of the third example, respectively.

Figure 14:
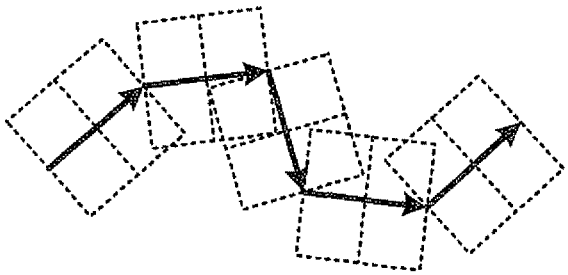
FIG. 14 is an explanatory diagram of stitches that are formed by unit stitches for a running stitch.
Figure 15:
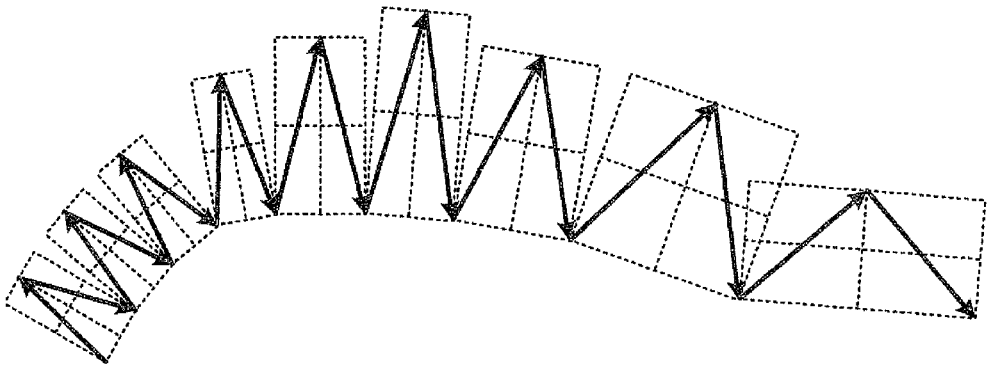
FIG. 15 is an explanatory diagram of stitches that are formed by unit stitches for a zigzag stitch.

Based on the sewing data generated in the processing at step S105, a control signal is output to the drive circuits 72 to 74, and one stitch is formed (step S110). In the processing at step S110, the rotation speed of the drive shaft (not shown in the drawings) is controlled to be equal to the speed set in the EEPROM 64. In a case where the main processing is repeatedly performed, stitches shown by arrows in FIG. 14 or FIG. 15, for example, may be formed. In FIG. 14, five unit stitches for a running stitch are formed. In FIG. 15, nine unit stitches for a zigzag stitch are formed such that some of the unit stitches vary in the ratio in the feed direction and the ratio in the width direction. Grids that are denoted by dashed lines in FIGS. 14 and 15 are not sewn.

The tilt amount T of the first lever 91 is acquired (step S115). The acquired tilt amount T is stored in the RAM 63. As described above, the tilt amount T is acquired based on the output signal that is output from the first lever 91 to the control portion 60. Next, based on the tilt amount T acquired in the processing at step S115, the rotation speed of the drive shaft per unit of time (hereinafter referred to as the "rotation speed") is set (step S120). The set rotation speed is stored in the EEPROM 64. In the present embodiment, the tilt amount T, which is expressed by 128 steps from 0 to 127, is classified into eight groups. The rotation speed is set that is associated in advance with each of the classified groups. The associated relationship between the rotation speed and each of the groups classified in accordance with the tilt amount T is stored in the EEPROM 64. For example, in a case where the tilt amount T is one of the values from 0 to 15, 70 rpm is set as the rotation speed. In a case where the tilt amount T is one of the values from 112 to 127, 400 rpm is set as the rotation speed. The rotation speed set in the processing at step S120 is referred to when the processing at step S110 is performed in the next cycle.

If the operation mode of the sewing machine 1 is the non-sewing mode in the processing at step S100 (NO at step S100), transfer data is generated (step S130). The generated transfer data is stored in the RAM 63. The transfer data is generated by adding an identification code to the coordinate data generated in the processing at step S95. For example, transfer data 231 shown in FIG. 16 are generated by adding an identification code "transfer" to the coordinate data (X1', Y1') of the above-described third example. Next, based on the generated transfer data, a control signal is output to the drive circuits 73 and 74, and the embroidery frame 32 is moved (step S135).

In the same manner as the processing at step S115, the tilt amount T of the first lever 91 is acquired (step S140). The acquired tilt amount T is stored in the RAM 63. Next, based on the tilt amount T acquired in the processing at step S140, an acquisition frequency of the output signal from the first lever 91 is set (step S145). The acquisition frequency defines a frequency of executing the processing from step S50 to step S145. The processing from step S50 to step S145 is executed at a frequency that is set based on the tilt amount T, so that the embroidery frame 32 is moved by a distance that corresponds to the tilt amount T in the sewing machine 1. In the present embodiment, the tilt amount T, which is expressed by 128 steps from 0 to 127, is classified into eight groups in the same manner as the processing at step S120. The acquisition frequency is set that is associated in advance with each of the classified groups. The associated relationship between the acquisition frequency and each of the groups classified in accordance with the tilt amount T is stored in the EEPROM 64. For example, in a case where the tilt amount T is one of the values from 0 to 15, 70 (times per minute) is set as the acquisition frequency. In the case where the tilt amount T is one of the values from 112 to 127, 400 (times per minute) is set as the acquisition frequency. The acquisition frequency set in the processing at step S145 is referred to when the processing at step S165 (which will be described below) is performed.

When the rotation speed is set (step S120) or when the acquisition frequency of the output signal from the first lever 91 is set (step S145), a determination is made as to whether the last initial coordinate data which are included in the unit data generated in the processing at one of step S70 and step S75 have been acquired in the processing at step S85 (step S160). If the last initial coordinate data have not been acquired in the processing at step S85 (NO at step S160), n is incremented by one and the processing returns to step S85. If the last initial coordinate data have been acquired in the processing at step S85 (YES at step S160), a determination is made as to whether a command to terminate processing in free motion sewing has been input (step S165). If the command to terminate the processing has not been input (NO at step S165), the processing returns to step S50. In a case where the acquisition frequency has been set in the processing at step S145, the processing returns to step S50 after a time period corresponding to the set acquisition frequency has elapsed. If the command to terminate the processing has been input (YES at step S165), the main processing is terminated.

With the sewing machine 1, stitches that are formed by unit stitches specified by the user may be sewn by free motion sewing. With the sewing machine 1, the user may input a command to specify a position where a unit stitch is formed by tilting the first lever 91, which is an easy operation. For example, when the user desires to output from the first lever 91 the same output signal for a certain time period, the user may tilt the first lever 91 in a certain direction at a certain angle for the certain time period. The user may operate the first lever 91 without moving the joystick 90. Since the first lever 91 is used in the sewing machine 1, the space necessary to operate an operation device for specifying the position where the stitch is formed as compared to a case where a pointing device is used. With the sewing machine 1, at least one of the size in the width direction and the size in the feed direction is changed in accordance with the tilt direction θ and the tilt amount T of the second lever 92. By operating the second lever 9, the user may select the unit stitch, and the user may also change the scale ratio in at least one of the width direction and the feed direction of the selected unit stitch. Therefore, the stitches formed by the unit stitches whose sizes have been changed by the ratio specified by the user's operating the second lever 92 may be sewn by free motion sewing. With the sewing machine 1 of the present embodiment, it is possible to change the size in the specified direction by appropriately setting the "size change in the feed direction" and the "size change in the width direction".

With the sewing machine 1, the coordinate data included in the sewing data may be easily generated based on the unit data. With the sewing machine 1, through the processing at step S120 shown in FIG. 11, unit stitches may be sewn at a speed that corresponds to the number of the unit stitches generated at step S70 or step S75. Therefore, the unit stitches may be formed to follow the output signal that is output from the first lever 91. Thus, the user may perform free motion sewing while visually checking the unit stitches that have already been sewn.

The sewing machine 1 according to the present disclosure is not limited to the above-described embodiment, and various types of modifications may be made within the scope of the present disclosure. For example, the modifications (A) to (D) described below may be made as appropriate.

(A) The shape and configuration of the sewing machine 1 can be modified as appropriate. For example, the sewing machine may be a multi-needle sewing machine that includes a plurality of needle bars. For example, in place of the embroidery unit 30, the sewing machine may include, as a transfer device, a feed mechanism provided with a function to move a work cloth in the feed direction and the width direction of a unit pattern, namely, a feed mechanism that moves the work cloth in the front-rear direction and the right-left direction.

The shape and configuration of the joystick 90 can be modified as appropriate. For example, the joystick 90 may include only the first lever 91. For example, the first lever 91 may be adapted to be tillable in predetermined directions (for example, eight directions). For example, the output signal of the first lever 91 may be any signal as long as the tilt amount and the tilt direction of the first lever 91 can be identified. This also applies to the output signal of the second lever 92. In place of the joystick 90, a device that interfaces with the user may be used. For examples, any one of a touch panel, a digitizer, a tablet, various types of switches of a game controller and the like, and a trackball may be used. The same type of device may be used for the following cases: a case where the unit stitch is specified; a case where the unit stitch forming position is specified; and a case where the scale ratio in at least one of the width direction and the feed direction of the unit stitch is specified. Alternatively, different types of devices may be used for the above-described cases.

(C) The processing performed in the mode setting processing can be modified as appropriate. For example, in the processing at step S5 shown in FIG. 10, the method to acquire the control command can be modified as appropriate. For example, in the processing at step S5, an output signal that output when an operation device other than the first button 93 is operated may be acquired as the control command. The operation device other than the first button 93 may be a device that interfaces with the user as exemplified in the above modification (B). For example, the control command to start control of the sewing machine motor 79 may be an output signal that output when the first lever 91 is first operated after the command to start free motion sewing has been input. For example, the control command to end the control of the sewing machine motor 79 may be a command which starts processing other than free motion sewing and which is input by a panel operation or the like after the processing in free motion sewing has been executed. For example, the control command may be a command to form reinforcement stitches that is input by a panel operation or the like. For example, the structure of the reinforcement stitch data generated at step S10 can be modified as appropriate. The mode setting processing may be omitted if necessary.

(D) The processing performed in the main processing can be modified as appropriate. For example, modifications (D-1) to (D-5) described below may be made to the main processing.

Figure 17:
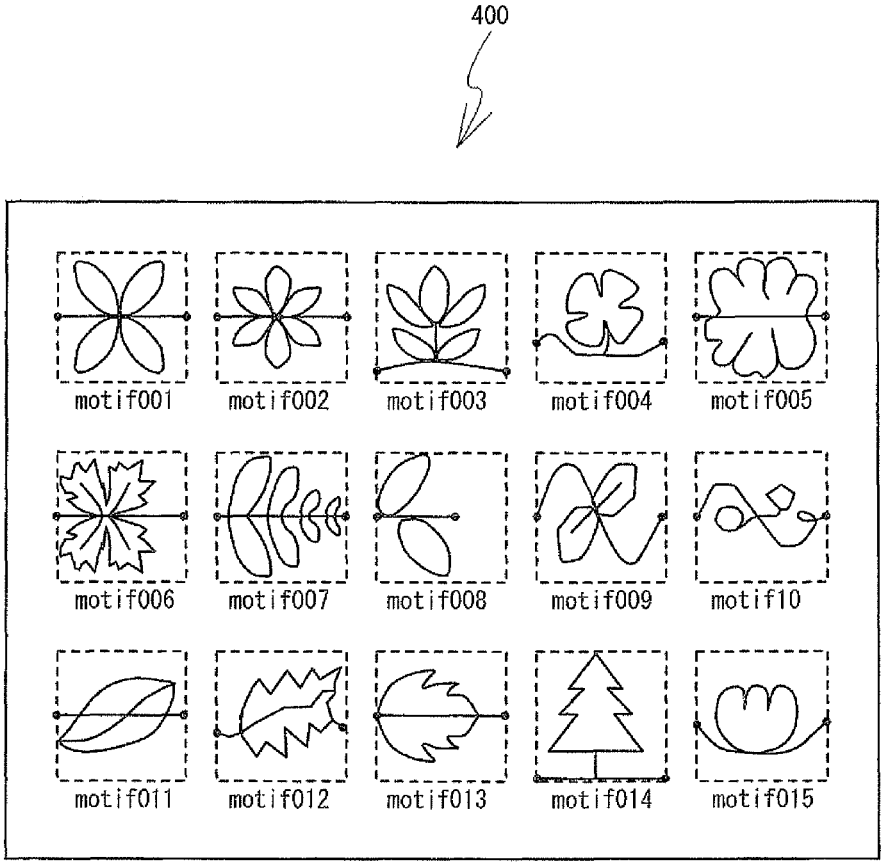
FIG. 17 is an explanatory diagram of a screen on which are displayed unit stitches for decorative stitches.

(D-1) The output signal of the first lever 91 may be acquired at a predetermined interval in the main processing. In such a case, the unit data sets whose number is based on the tilt amount T of the first lever 91 may be generated at one time. Thus, the sewing machine may generate sewing data for forming stitches having the length specified by the tilting operation of the first lever 91 by unit stitches, in the same manner as the main processing of the above-described embodiment. For example, the type of the unit data acquired by the processing at step S70 or step S75 may be modified as appropriate. Specifically, for example, in addition to single stitch data for sewing a running stitch and two stitch data for sewing a zigzag stitch that are shown in the above-described embodiment, the unit data may be data for a decorative stitch including a plurality of stitches, examples of which are shown in FIG. 17. For example, a unit pattern may be set based on an output signal in accordance with a panel operation from among decorative stitches displayed on a screen 400 shown in FIG. 17. Fifteen types of unit patterns for the decorative stitches are displayed on the screen 400. The feed direction of the unit patterns is a direction from the left to the right of the page in FIG. 17. The width direction of the unit patterns is the up-down direction of the page in FIG. 17. In a case where data of a plurality of stitches for sewing a decorative stitch are set as a unit pattern, stitches of the decorative stitch having a complicated shape may be formed by free motion sewing.

(D-2) The method to generate the coordinate data in the processing at step S95 shown in FIG. 11 may be modified as appropriate, for example, in accordance with the output signal output from the first lever 91 and the coordinate system of the X axis motor 81 and the Y axis motor 82. The method to generate the sewing data in the processing at step S105 may be modified as appropriate in accordance with the data structure of the sewing data. For example, the control to perform sewing in the processing at step S110 may be modified as appropriate in accordance with the configuration of the sewing machine.

(D-3) The method to set the rotation speed in the processing at step S120 and the method to set the acquisition frequency in the processing at step S145 may be modified as appropriate. For example, the relationship between the tilt amount T of the first lever 91 and the rotation speed of the drive shaft may be modified as appropriate. For example, the rotation speed of the drive shaft may be calculated in the processing at step S120 by substituting the tilt amount T acquired by the processing at step S115 into a predetermined calculation formula. For example, the method to generate the transfer data may be modified as appropriate. For example, the transfer data may be generated without using the unit data. In such a case, for example, the output signal (vector data, for example) from the first lever 91 may be converted to coordinate data included in the transfer data by substituting the output signal into a predetermined calculation formula. In a case where there is no need to move the embroidery frame 32 as the processing in the non-sewing mode, the processing from steps S130 to S145 may be omitted.

(D-4) In the sewing machine 1, in the scaling processing shown in FIG. 12, the size in the width direction and the size in the feed direction of the zigzag stitch can be changed. However, the size in either the width direction or the feed direction may be changeable. In such a case, a stitch formed by a unit pattern, in which the size in either the width direction or the feed direction is changed, can be sewn by free motion sewing. For example, in the sewing machine 1, regardless of whether the "size change in the feed direction" is activated, the ratio of the size in the feed direction may be set in accordance with the output signal from the second lever 92. In the same manner, in the sewing machine 1, regardless of whether the "size change in the width direction" is activated, the ratio of the size in the width direction may be set in accordance with the output signal from the second lever 92. For example, the method to set the scale ratio can be changed as appropriate. For example, the scale ratio in the feed direction may be set to be the same as the scale ratio in the width direction. For example, in the sewing machine 1, the type of the unit data to be generated may be set in accordance with the tilt direction of the second lever 92. The scale ratios in the feed direction and the width direction may be set in accordance with the tilt amount T of the second lever 92. In such a case, a plurality of tilt directions (for example, eight directions) may be set, and the unit data may be allocated to each of the tilt directions. Thus, it is possible to increase the number of sets of the unit data that can be set in the processing at step S65. For example, the scale ratio may be set based on a predetermined calculation formula using vector data. The scaling processing may be omitted if necessary.

(D-5) A stitch position indication line that indicates the position where stitches are to be formed by free motion sewing, and a stitch line that indicates the position of stitches that have been formed by free motion sewing may be displayed on the LCD 10. Further, in a case where a sewing command is issued after the user has confirmed the stitch position indication line, stitches may be formed by free motion sewing in the position indicated by the stitch position indication line. For example, Japanese Laid-Open Patent Publication No. 2008-246186 discloses a sewing machine that causes an LCD to display the stitch position indication line and the stitch line, and a sewing machine in which stitches are formed by free motion sewing in the position indicated by the stitch position indication line in a case where a sewing command is issued, the relevant portions of which are incorporated by reference.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a transfer device that is adapted to move a work cloth;

a sewing device that moves a needle bar, to a bottom end of which a needle can be attached, up and down;

a first operation device that outputs a first output signal in accordance with an operation state of the first operation device, the first output signal specifying a type of a unit stitch formed by at least one stitch;

a second operation device that outputs a second output signal in accordance with an operation state of the second operation device, the second output signal specifying a position where the unit stitch is sewn on the work cloth;

a sewing data generation device that generates sewing data in accordance with the first output signal and the second output signal, the sewing data including coordinate data that specify the position where the unit stitch is sewn;

a transfer control device that causes the work cloth to be moved by driving the transfer device in accordance with the sewing data generated by the sewing data generation device; and a sewing control device that causes the unit stitch to be sewn on the work cloth by driving the sewing device in accordance with the sewing data generated by the sewing data generation device.

2. The sewing machine according to claim 1, further comprising:

a third operation device that outputs a third output signal in accordance with an operation state of the third operation device, the third output signal specifying a scale ratio in at least one of a width direction and a feed direction of the unit stitch of the type specified by the first output signal, and the feed direction being a direction orthogonal to the width direction, wherein the sewing data generation device includes a scaling device that generates the coordinate data on which at least one of enlargement processing and reduction processing is performed based on the scale ratio specified by the third output signal in a case where the third output signal is output by the third operation device.

3. The sewing machine according to claim 2, wherein the third output signal specifies at least the scale ratio in the feed direction of the unit stitch.

4. The sewing machine according to claim 2, wherein the third output signal specifies at least the scale ratio in the width direction of the unit stitch.

5. The sewing machine according to claim 1, wherein the sewing data generation device includes:

a unit data generation device that generates unit data being data for forming the unit stitch of the type specified by the first output signal, and the number of sets of the unit data being based on the second output signal; and a conversion device that converts the unit data to the coordinate data based on the second output signal.

6. The sewing machine according to claim 1, further comprising a speed setting device that sets a drive speed of the sewing device based on the second output signal.

7. The sewing machine according to claim 2, wherein:

the first operation device includes a first operation member, a type of a unit stitch specified by the first output signal that is output when the first operation member is tilted is different from a type of a unit stitch specified by the first output signal that is output when the first operation member is not tilted, the second operation device includes a second operation member, and outputs the second output signal in accordance with a tilting operation of the second operation member, and the third operation device outputs the third output signal in accordance with at least one of a tilt direction and a tilt amount of the first operation member.

8. A computer-readable medium storing a control program executable on a sewing machine, the program comprising instructions that cause a computer to perform the steps of:

receiving a first output signal that is output from a first operation device of the sewing machine and that specifies a type of a unit stitch formed by at least one stitch;

receiving a second output signal that is output from a second operation device of the sewing machine and that specifies a position where the unit stitch is sewn on a work cloth;

generating sewing data in accordance with the first output signal and the second output signal, the sewing data including coordinate data that specify the position where the unit stitch is sewn;

causing the work cloth to be moved by driving a transfer device in accordance with the generated sewing data, the transfer device being adapted to move the work cloth; and causing the unit stitch to be sewn on the work cloth by driving a sewing device in accordance with the generated sewing data, the sewing device moving a needle bar, to a bottom end of which a needle can be attached, up and down.

9. The computer-readable medium according to claim 8, wherein:

the program further comprises instructions that cause the computer to perform the step of receiving a third output signal that is output from a third operation device of the sewing machine, the third output signal specifying an scale ratio in at least one of a width direction and a feed direction of the unit stitch of the type specified by the first output signal, and the feed direction being a direction orthogonal to the width direction, and the step of generating the sewing data includes the step of generating the coordinate data on which at least one of enlargement processing and reduction processing is performed based on the scale ratio specified by the third output signal in a case where the third output signal is received.

10. The computer-readable medium according to claim 9, wherein the third output signal specifies at least the scale ratio in the feed direction of the unit stitch.

11. The computer-readable medium according to claim 9, wherein the third output signal specifies at least the scale ratio in the width direction of the unit stitch.

12. The computer-readable medium according to claim 8, wherein the step of generating the sewing data includes the steps of:

generating unit data being data for forming the unit stitch of the type specified by the first output signal, and the number of sets of the unit data being based on the second output signal; and converting the unit data to the coordinate data based on the second output signal.

13. The computer-readable medium according to claim 8, wherein the program further comprises instructions that cause the computer to perform the step of setting a drive speed of the sewing device based on the second output signal.

14. The computer-readable medium according to claim 9, wherein:

a type of a unit stitch specified by the first output signal that is received when the first operation member is tilted is different from a type of a unit stitch specified by the first output signal received when the first operation member is not tilted, the first operation member being included in the first operation device, the second output signal that is output in accordance with a tilting operation of a second operation member is received, the second operation member being included in the second operation device, and the third output signal that is output in accordance with at least one of a tilt direction and a tilt amount of the first operation member is received.

* * * * *